US008776749B2

(12) United States Patent
Pattakos et al.

(10) Patent No.: US 8,776,749 B2
(45) Date of Patent: Jul. 15, 2014

(54) DESMODROMIC HYDRAULIC VALVE TRAIN

(76) Inventors: Manousos Pattakos, Nikea Piraeus (GR); John Pattakos, Nikea Piraeus (GR); Emmanouel Pattakos, Nikea Piraeus (GR)

( * ) Notice: Subject to any disclaimer, the term of this patent is extended or adjusted under 35 U.S.C. 154(b) by 117 days.

(21) Appl. No.: 13/602,106

(22) Filed: Sep. 1, 2012

(65) Prior Publication Data

US 2013/0055974 A1 Mar. 7, 2013

(30) Foreign Application Priority Data

Sep. 2, 2011 (GB) ..... 1115137.0

(51) Int. Cl.
*F01L 1/30* (2006.01)
*F01L 9/02* (2006.01)
*F01L 1/20* (2006.01)

(52) U.S. Cl.
CPC . *F01L 1/30* (2013.01); *F01L 9/023* (2013.01); *F01L 1/20* (2013.01); *F01L 9/025* (2013.01)
USPC ..... 123/90.24; 123/90.12

(58) Field of Classification Search
CPC ..... F01L 1/30; F01L 9/023; F01L 1/20; F01L 9/025
USPC ..... 123/90.12, 90.24, 90.25, 90.26, 90.28
See application file for complete search history.

(56) References Cited

U.S. PATENT DOCUMENTS

| | | | | |
|---|---|---|---|---|
| 6,505,590 | B1 * | 1/2003 | Rao et al. | 123/90.24 |
| 7,077,088 | B1 * | 7/2006 | Decuir, Jr. | 123/90.24 |
| 2008/0314342 | A1 * | 12/2008 | Pattakos et al. | 123/90.16 |
| 2010/0162978 | A1 * | 7/2010 | Pattakos et al. | 123/90.16 |

* cited by examiner

*Primary Examiner* — Thomas Denion
*Assistant Examiner* — Jorge Leon, Jr.

(57) ABSTRACT

The mass production of the MultiAir/UniAir of Fiat/INA proves that the hydraulic control can reliably actuate the valves of the modern internal combustion engines, making them greener. Removing the valve springs from the valves and controlling by the cam not only the valve opening but also the valve restoring, the hydraulic system has easier work to do, the rev limit increases, the height and the cost of the engine decrease and the engine can operate according all the MultiAir strategies.

Optionally, the control by high speed solenoid valves can be replaced by easier and cheaper control wherein the rotation of the oil piston is what varies the valve lift and the valve duration. If necessary, slow, cheap, low power servomotors can micro-align the angular displacement of different oil pistons to balance the load between the cylinders.

9 Claims, 9 Drawing Sheets

DESMODROMIC HYDRAULIC VALVE TRAIN

Closest prior art: the Multiair (or UniAir, or TwinAir) system of Fiat, U.S. Pat. No. 6,918,364 etc, an electronically controlled hydraulic VVA currently in mass production, wherein an "oil push rod" is interposed between the valve and the cam; the cam pushes the "oil push rod" and the "oil push rod" pushes the valve; at the right moment a solenoid valve opens, the "oil push rod" collapses and the valve closes under the restoring action of the valve spring; a "hydraulic braking mechanism" smoothes the landing of the valve. A Hydraulic Desmodromic valve train, the HyDesmo, is here disclosed.

A valve 1 comprises a valve piston 2 and a valve stem 3, the valve piston 2 is secured to the valve stem 3;
the one end of the valve piston 2 is slidably fitted and seals one side of an opening oil chamber 4;
the other end of the valve piston 2 is slidably fitted and seals one side of a closing oil chamber 5;
a cam 6 actuates an oil piston 7;
the oil piston 7 is slidably fitted and seals one side of an oil chamber 8;
the cam 6 moves in synchronization to the engine and forces the oil piston 7 to perform an actuating motion wherein the oil piston displaces oil out of the oil chamber 8;
an oil reservoir 11, the cam 6 controls the oil piston 7 restoring motion wherein oil from the oil reservoir 11 enters into the oil chamber 8;
by control means 71, 10, and channels 9, the oil chamber 8 and the oil reservoir 11 are connected controllably with the opening oil chamber 4 and with the closing oil chamber 5,
the actuating motion of the oil piston comprises an initial part wherein the oil from the oil chamber is directed, according the state of the control means, either to the opening oil chamber and displaces the valve to open positively, or to the closing oil chamber and displaces the valve to close positively,
the actuating motion of the oil piston comprises a final part wherein the oil from the oil chamber is directed to the closing oil chamber and displaces the valve to close positively,
the final part of the actuating motion is adequately long to guarantee that, at all operational conditions, at the end of the actuating motion of the oil piston the valve will be closed.

The cam 6 pushes "downwards" the oil piston 7 during the valve opening and during valve closing, providing the necessary force, and power, to cause the valve motion, so that the valve 1 opens positively and closes positively, so that the HyDesmo is a desmodromic valve train.

FIG. 1 shows an embodiment wherein the hydraulic mechanical system actuates the valve, while a solenoid electromagnetic valve controls the valve motion. The cam is an eccentric pin, or crankpin, that rotates in synchronization to the crankshaft of the engine, at half crankshaft speed. This embodiment is a desmodromic version of the MultiAir system of Fiat: it provides all the available modes/strategies of the MultiAir.

Figure 6:
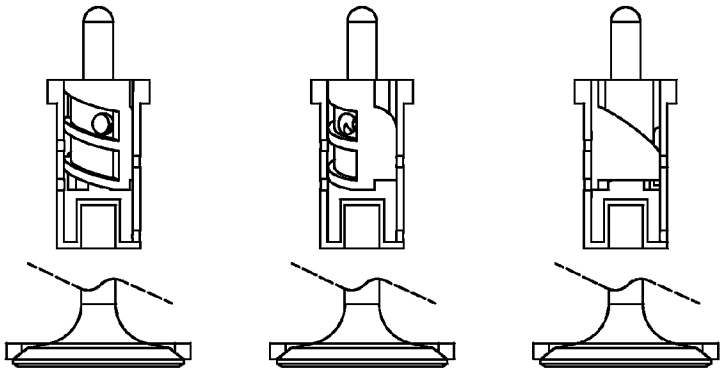
FIG. 6 shows the oil piston into the oil chamber of the embodiment of FIG. 4, it also shows the lower part of the valve and the valve seat; at left the full lift/full duration mode is shown, at middle it is shown a medium-lift/short-duration mode, at right it is shown the valve deactivation mode.
Figure 7:
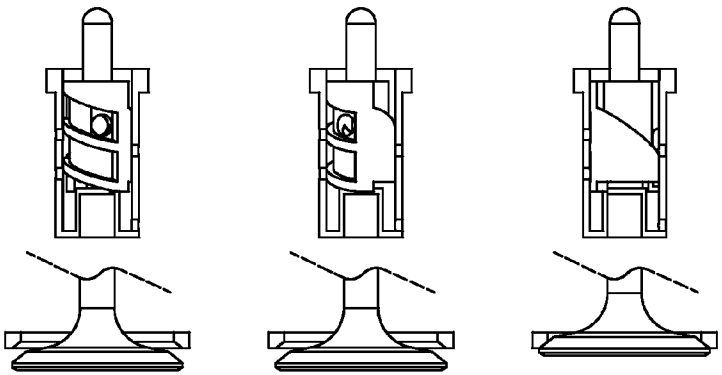

FIG. 7 shows what FIG. 6 for another camshaft angle. The valve at left continuous to open. The valve at the middle is starting to close.

Figure 8:
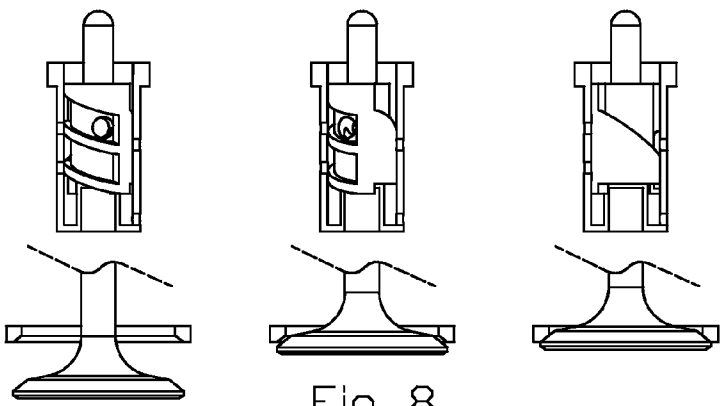

FIG. 8 shows what FIG. 7 for another camshaft angle. Here the valve at left is at the maximum lift, while the valve at middle is almost closed.

Figure 9:
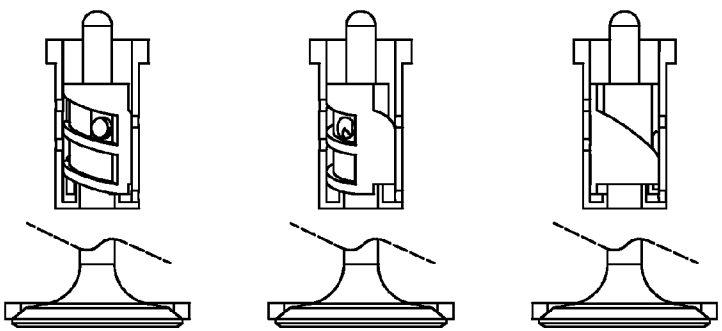

FIG. 9 shows what FIG. 8 for another camshaft angle; the valve is closed in all modes.

Figure 10:
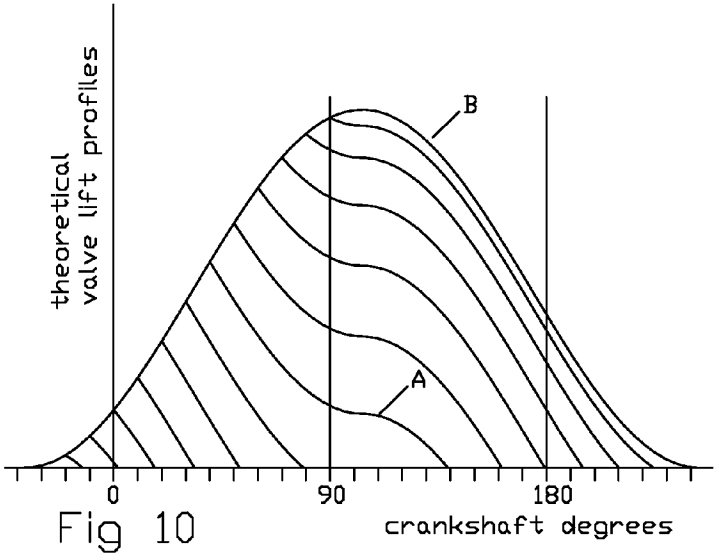

FIG. 10 shows a few, from the infinite available, valve lift profiles; here the full lift profile, curve B, is sinusoidal.

Figure 11:
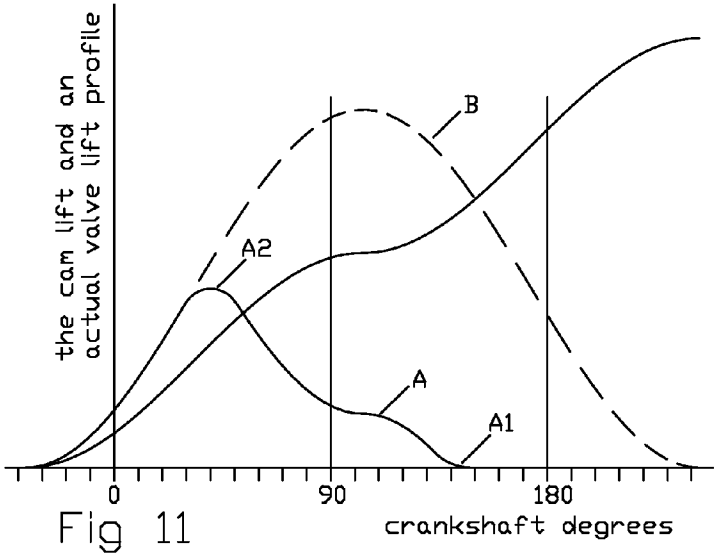

FIG. 11 shows the cam lift profile. It also shows the actual valve lift profile A that corresponds to the theoretical valve lift profile A of FIG. 10: the oil smoothes the valve motion reversal; also the hydraulic braking of the oil, as it leaves through the progressively covered holes around the opening oil chamber, smoothes the valve landing on the valve seat.

Figure 4:
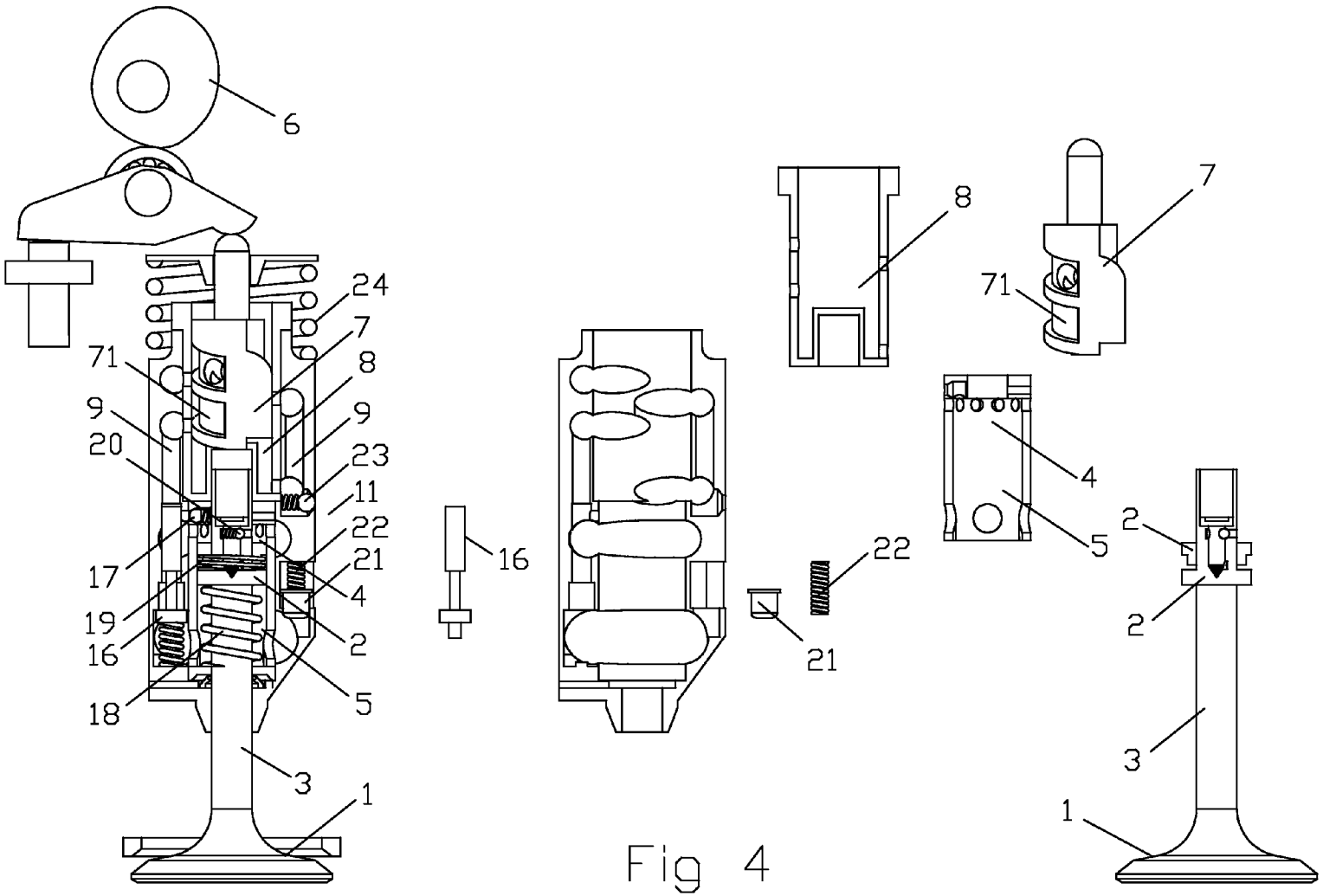
FIG. 4 shows another embodiment assembled at left, and exploded at right. The control is mechanical: the angular displacement of the oil piston 7, relative to the oil chamber 8, defines the valve lift profile, likewise the angular displacement of the piston of a jerk pump defines the quantity of the injected fuel.
Figure 5:
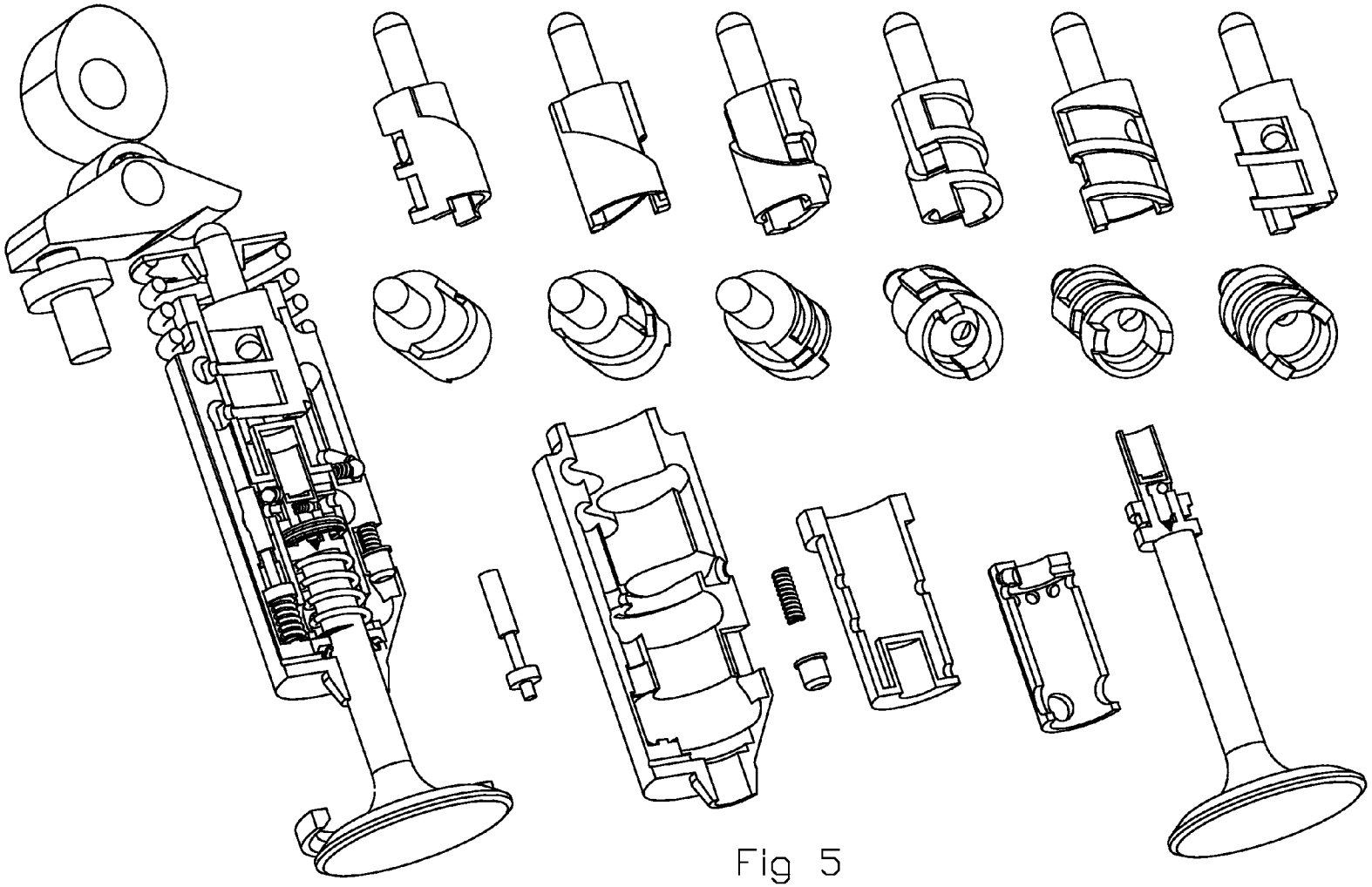
FIG. 5 shows what FIG. 4 from a different viewpoint. The oil piston is shown from various viewpoints.
Figure 12:
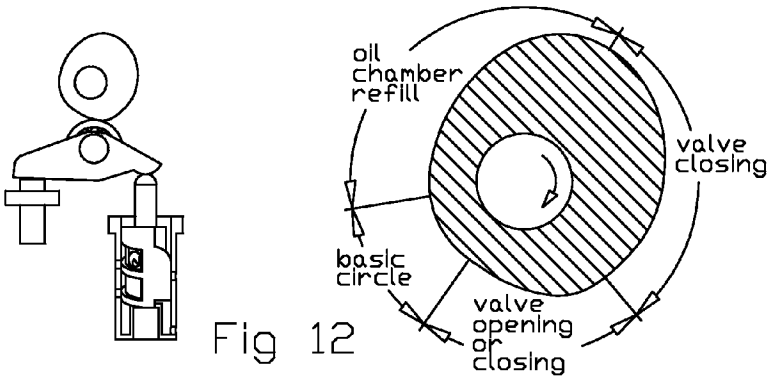
Figure 13:
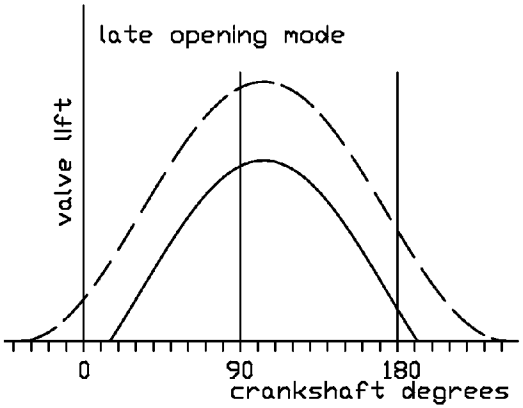
Figure 14:
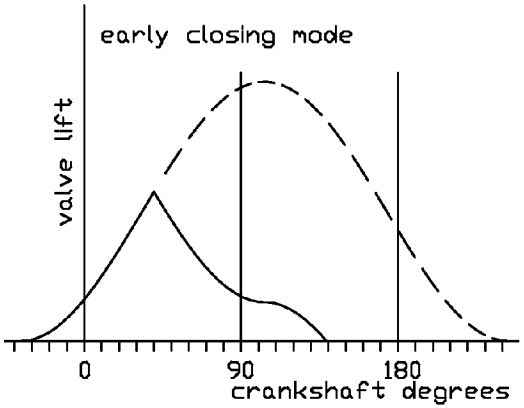
Figure 15:
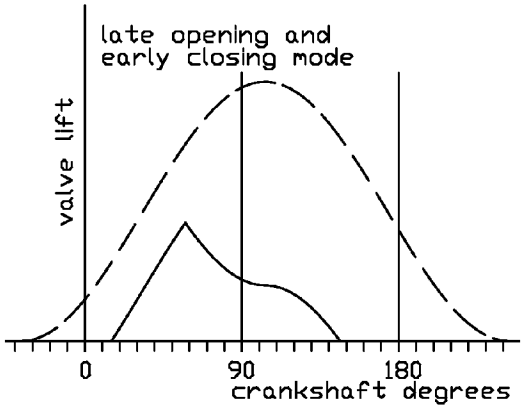
Figure 16:
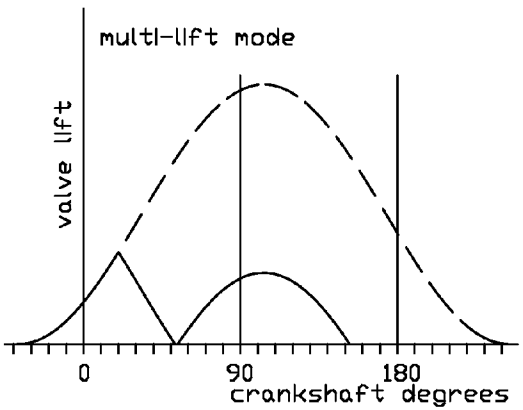
Figure 17:
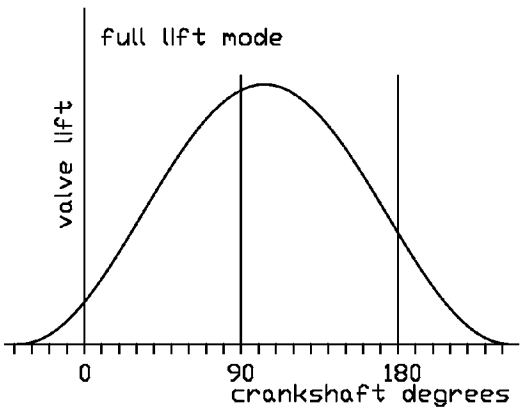
Figure 18:
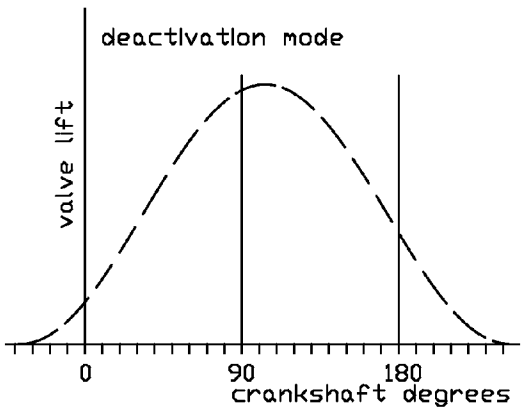

FIG. 12 shows, at left, the rocker arm and the cam of the embodiment of FIG. 4, and at right the cam lobe magnified.

Figure 1:
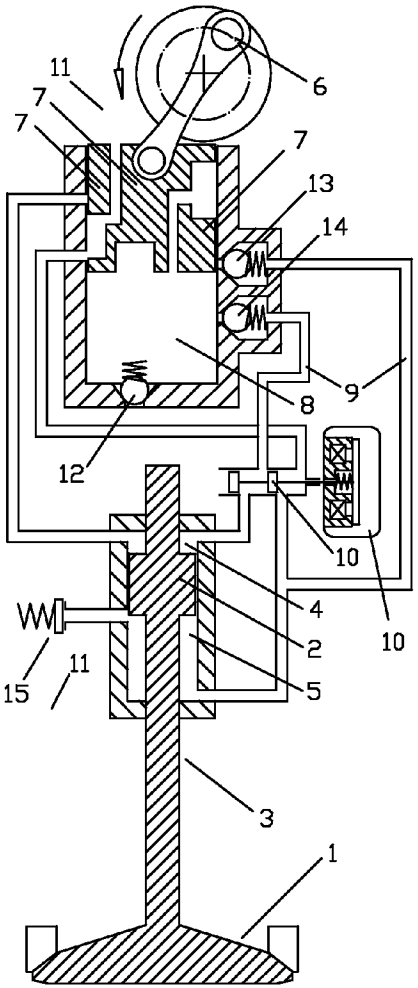

FIGS. 13 to 18 show the various modes the embodiment of FIG. 1 can operate; they are all the modes/strategies of the MultiAir.

Figure 19:
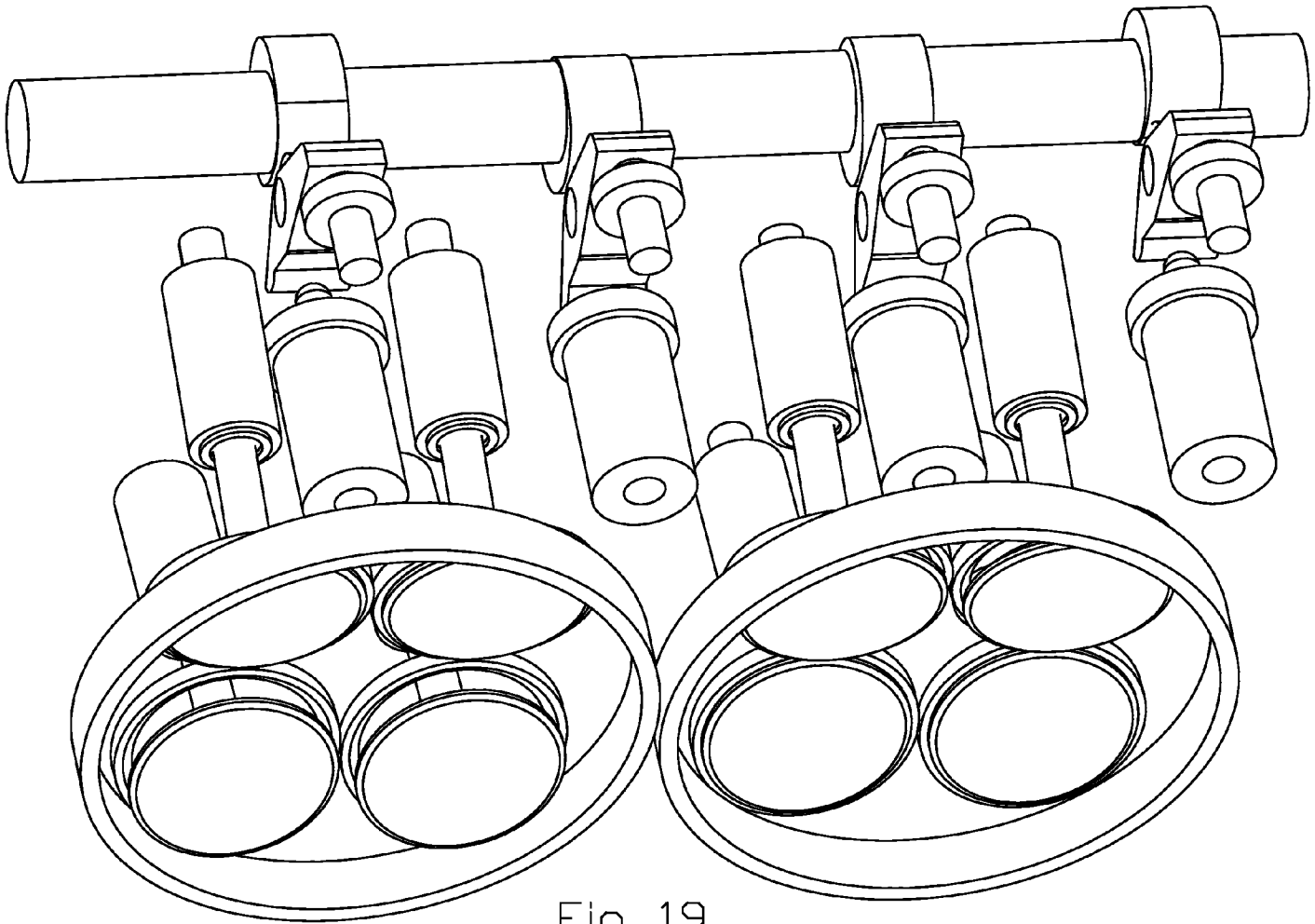

FIG. 19 shows the application of the embodiment of FIG. 4 to a multicylinder engine.

Figure 20:
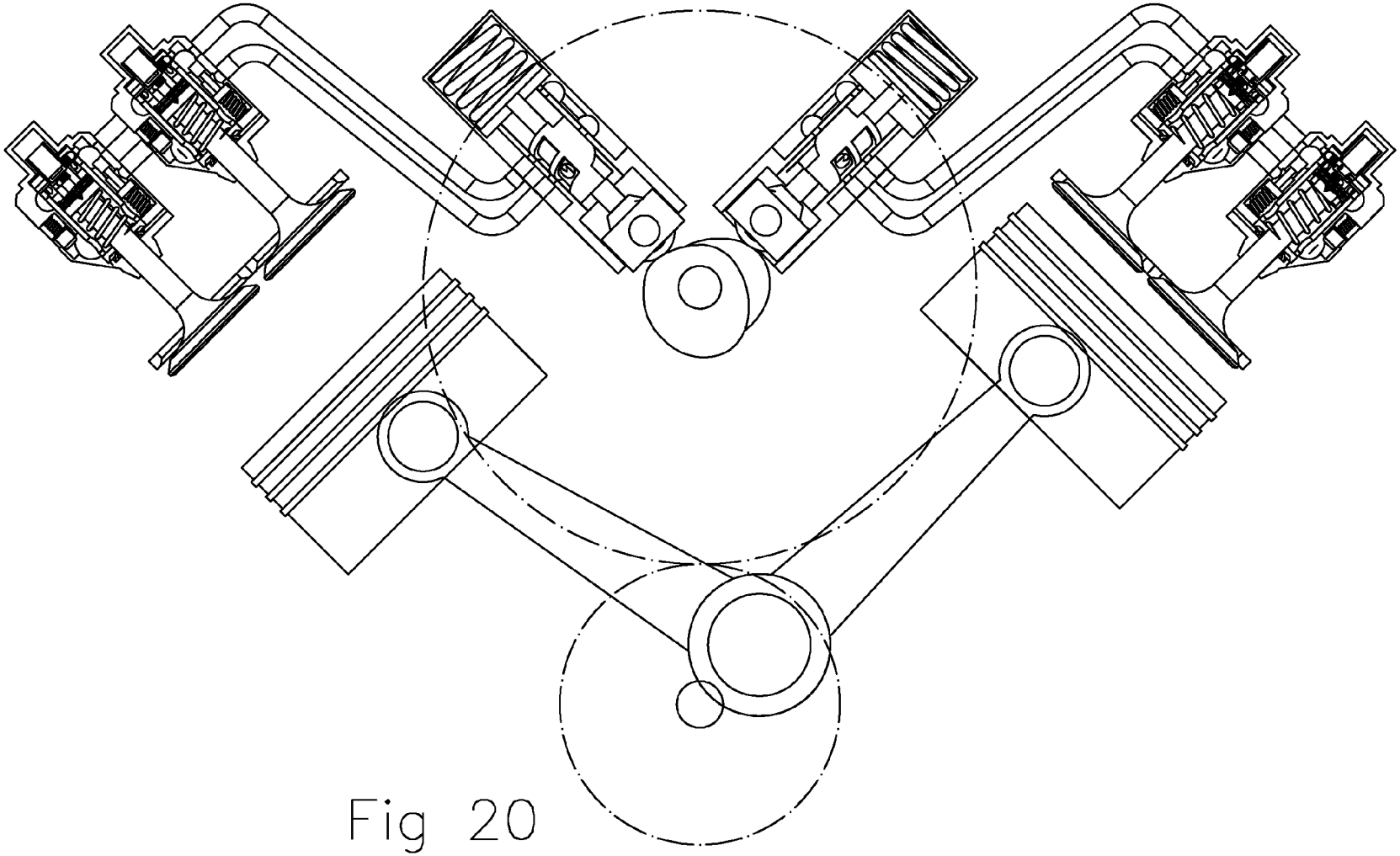

FIG. 20 shows another embodiment: the application of the HyDesmo on a side cam Vee engine.

Figure 21:
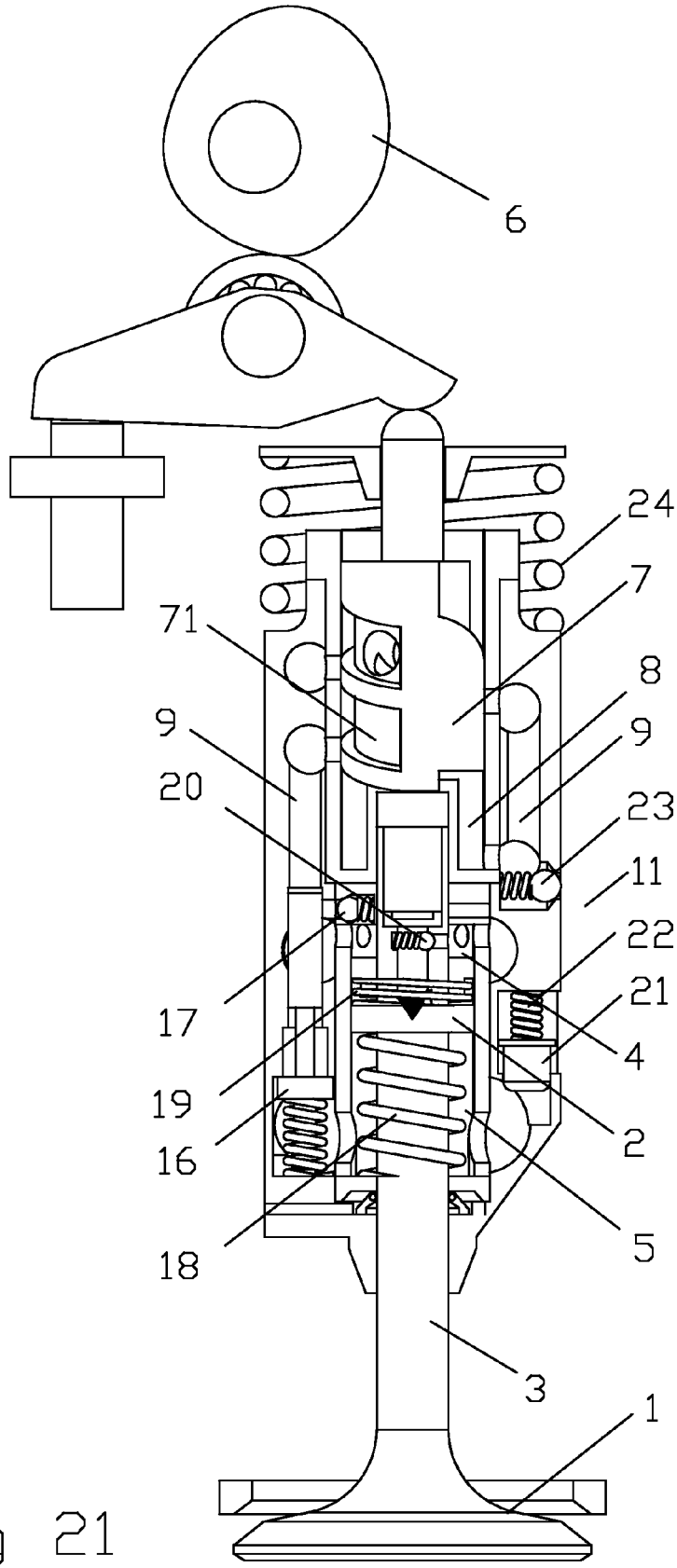

FIG. 21 shows the embodiment of FIG. 4 magnified.

In a first embodiment, FIGS. 4 to 12 and 19 to 21, the cam 6, rotating in synchronization to the crankshaft of the engine, starts displacing the oil piston 7. The oil piston 7 displaces oil out from the oil chamber 8; the oil is directed to the opening oil chamber 4 to displace the valve 1 to open; initially the oil displaces the check valve 16, allowing the closing oil chamber 5 to communicate with the oil reservoir 11; the oil entering into the opening oil chamber 4 passes, at first, through the one way valve 17, then it enters through both, the one way valve 17 and the "braking holes" around the opening oil chamber. At a crankshaft angle, depending on the angular displacement of the oil piston 7 relative to the oil chamber 8, the opening oil chamber 4 stops communicating with the oil chamber 8 and starts communicating with the oil reservoir 11, while the closing oil chamber 5 stops communicating with the oil reservoir 11 and starts communicating with the oil chamber 8; now the oil exiting from the oil chamber 8 is directed to the closing oil chamber 5, displacing the valve 1 to close; the excess oil from the opening oil chamber 4 is directed to the oil reservoir 11; when the valve 1 is about to land on the valve seat, the "holes" around the opening oil chamber 4 are progressively covered by the valve piston 2, decelerating/braking the valve motion and enabling smooth valve landing. With the valve closed, the oil chamber 8 starts communicating with the oil reservoir 11; the check valve 16 does not allow the oil to exit from the closing oil chamber 5, and the valve 1 remains firmly closed. During the restoring (upwardly) motion of the oil piston 7, oil entering through the one way valve 23 fills the oil chamber 8.

The niches and the galleries of the oil piston 7, and the ports of the oil chamber 8, are such that, no matter what the angular displacement of the oil piston 7 relative to the oil chamber 8 is, for as long as oil from the oil chamber 8 goes to the opening oil chamber 4, the closing oil chamber 5 communicates with the oil reservoir 11, and for as long as oil from the oil chamber 8 goes to the closing oil chamber 5, the opening oil chamber 4 communicates with the oil reservoir 11. I.e. besides displacing oil, the oil piston serves also as the control means: in synchronization to the crankshaft of the engine the oil piston permits and forbids the communication of the opening oil chamber 4 and of the closing oil chamber 5 with the oil chamber 8 and with the oil reservoir 11. During the valve closing and until the moment the valve is finally closed, the oil piston niches and galleries, in cooperation with the oil chamber ports, direct the oil from the oil chamber 8 to the closing oil chamber 5; after the valve closing, the oil piston niches and galleries, in cooperation with the oil chamber ports, direct the oil from the oil chamber 8 to the oil reservoir 11.

With more than half of the downwards motion of the oil piston dedicated, at all possible modes of operation, to the valve closing, the hydraulic-mechanical system guarantees that at the end of the actuating motion of the oil piston 7, the valve 1 will always be closed.

Having a single opening ramp of a rotating cam to cause both, the opening and the closing of the valve, and having a single part, the oil piston, to control the communication between the various oil chambers, the system becomes as accurate, as simple and as reliable as it gets.

The roller of the rocker arm, FIG. 12, rolls initially along the "valve opening or closing" section of the cam lobe; depending on the angular displacement of the oil piston 7 relative to the oil chamber 8, the valve can either open or close. Near the middle stroke of the oil piston 7, i.e. near the middle of the opening ramp of the cam 6, the roller of the rocker arm starts rolling along the "valve closing" section of the cam; if the valve is still open, it closes; if the valve is closed, it remains closed. The "valve opening or closing" section and the "valve closing" section comprise the opening ramp of the cam. After the "valve closing" section, the roller of the rocker arm rolls along the "oil chamber refill" section of the cam, which is the closing ramp of the cam; the valve remains closed; the restoring spring 24 pushes the oil piston upwards to follow the "oil chamber refill" section of the cam; oil enters and fills the oil chamber 8, through the one way valve 23. Then the roller of the rocker arm rolls along the "basic circle" section of the cam during which the valve remains closed.

The duration of the opening ramp of the cam lobe, i.e. the duration of the "valve opening or closing" section plus the duration of the "valve closing" section, FIG. 12, equals to the maximum valve duration because the opening ramp of the cam controls the valve motion not only during the valve opening but also during the valve closing. For instance, for 270 crank degrees valve duration (in the conventional engine this means nearly 135 crank degrees opening ramp duration), the duration of the opening ramp of the HyDesmo cam lobe needs to be of at least 270 crank degrees. Given the desirable full lift profile and given the geometry of the system, the opening ramp of the cam lobe is calculated. Until the maximum valve lift, the valve lift profile and the oil piston lift profile "match", i.e. they have similar shape. After the maximum valve lift, the oil piston lift profile "matches" with the negative valve lift profile. According FIGS. 10 and 11, in case the opening oil chamber stops communicating with the oil chamber at 40 crankshaft degrees, the valve moves according the A valve lift profile: the valve starts opening at −30 crankshaft degrees and follows, for 70 crankshaft degrees, the full lift curve B; then the valve starts closing. Until the angle the curve B is maximized (at about 105 degrees in FIG. 10), the closing curve A is the symmetrical of the full lift curve B about the horizontal line from the intersection point of the B and A curves; then the curve A keeps constant distance from the curve B.

An auxiliary/safety spring 18 holds the valve from "dropping" towards the combustion chamber during engine's stall.

A hydraulic lash adjuster (spring 19, one way valve 20) controls the valve lash.

An auxiliary piston 21 is slidably fitted to, and seals, one side of the closing oil chamber 5; together with its supporting spring 22, it serves as an oil pressure surge compensation means: during the pressure surging, the piston 21 moves slightly outwards of the closing oil chamber 5 dumping the pressure surge; when the pressure drops, the piston 21 moves, by the supporting spring 22, slightly inwards the closing oil chamber 5 to compensate any oil leakage and to keep, this way, the valve firmly closed until the next valve opening.

As shown in FIG. 19, the single camshaft actuates, by four camlobes, four oil pistons into four oil chambers, each controlling a pair of valves. The oil chamber at right, actuates the two exhaust valves of the cylinder at right, while the second, from right, oil chamber is disposed between the two intake valves, shown slightly open, and actuates them; the third, from right, oil chamber is disposed in the space between the two cylinders (only the top part of the cylinder liners are shown) and actuates the two exhaust valves, shown open, of the left cylinder; the left oil chamber is disposed between the two intake valves of the left cylinder and actuates them.

By angularly displacing the oil piston relative to the oil chamber, the duration and the lift of the valve vary. The system can offer a continuous range of valve lifts starting from zero, enabling the throttling by the intake valves, i.e. enabling the throttle-less operation. The pure mechanical control is an option: in a HyDesmo motorcycle, for instance, the driver can rotate, by the grip and the gas-cable, the oil piston relative to the oil chamber, just like he controls the throttle valve in a conventional engine. The fuel system can align the quantity of the fuel with the air entering the cylinder (oil piston angular displacement sensor, rev sensor, lambda sensor, loop control etc).

The electronic control is another option. With servomotors controlled by the ECU, the angles of the oil pistons of different oil chambers are micro-aligned (fine tuning) in order to balance the operation of different cylinders based on lambda sensors, on the feedback control etc. This fine-tuning needs not the high-power instant-response solenoid electromagnetic valves of the MultiAir system. The ECU can complete the micro alignment in a few rotations of the crankshaft. In case the ECU fails to control the servomotors, the engine continues to operate based on the mechanical control.

In another embodiment, FIGS. 1 to 3, and 10 to 18, the system has an electronic control similar to that of the MultiAir system. A high speed electromagnetic valve 10 controls the communication of the oil chamber 8 with the opening oil chamber 4 and the closing oil chamber 5. The oil piston 7 is connected to an eccentric pin 6 (this is the cam) by a connecting rod. The offset of the crankshaft provides longer valve duration. Instead of the eccentric pin 6, the cam and the rocker arm and the restoring spring 24 of the embodiment of FIG. 4 can be used.

In FIG. 1 the valve is closed, the solenoid valve is actuated (on). As the crankpin 6 rotates, the oil piston 7 pushes oil to the opening oil chamber 4. The closing oil chamber 5 communicates with the oil reservoir 11 (through the gallery at the upper left side of the oil piston). The valve 1 opens.

Figure 2:
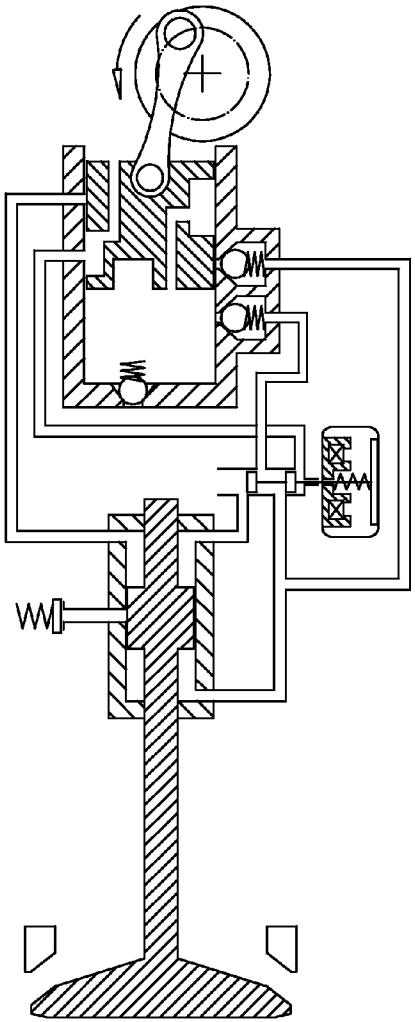
FIG. 2 shows the embodiment of FIG. 1 after 60 camshaft degrees. A connecting rod connects the oil piston with the eccentric pin.

In FIG. 2 the solenoid valve is deactivated (off). Now the opening oil chamber 4 communicates with the oil reservoir 11, while the closing oil chamber 5 communicates with the oil chamber 8. The oil coming from the oil chamber 8 displaces the valve 1 towards its valve seat.

Figure 3:
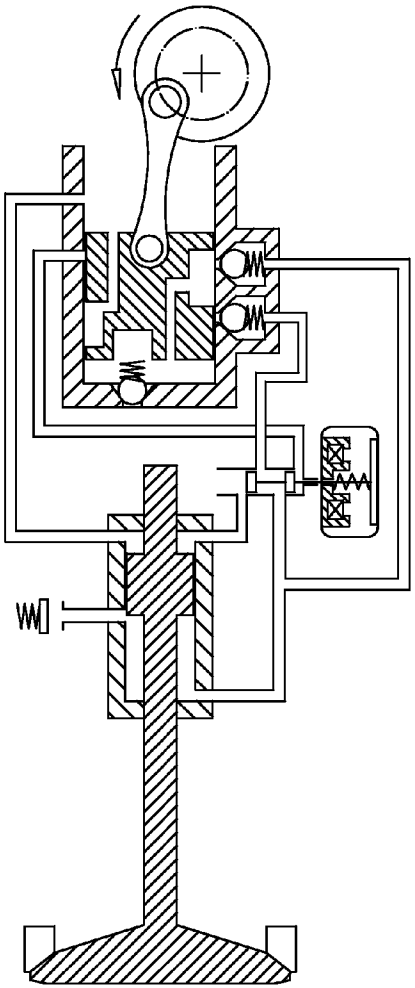
FIG. 3 shows the embodiment of FIG. 1 after 160 camshaft degrees.

In FIG. 3 the valve 1 is closed. The oil coming from the oil chamber 8 enters into the closing oil chamber 5 and exits to the oil reservoir 11 through the waste valve 15. Optionally, a secondary electromagnetic valve can be added to allow the oil discharge from the closing oil chamber with less friction loss.

Near its middle stroke the oil piston covers the oil chamber port wherein the one way valve 14 resides; for the rest of the downward motion of the oil piston, the oil from the oil chamber is directed to the closing oil chamber 5 through the one way valve 13; this way the hydraulic-mechanical system guarantees that at the end of the downwards motion of the oil piston 7, the valve 1 will always be closed.

When the piston starts its upward motion, oil enters through the one-way valve 12 into the oil chamber; the other two one-way valves 13 and 14 prevent oil leakage from the closing oil chamber 5, keeping the valve firmly closed.

Without valve restoring springs, this embodiment realizes all the "strategies" of the MultiAir system of Fiat, as FIGS. 13 to 18 show: early valve closing (the electromagnetic valve turns off early);

late valve opening (for an initial part of the downward motion of the oil piston the electromagnetic valve is off);

multi-lift (the electromagnetic valve is activated and deactivated more than once during the downward motion of the oil piston);

late opening—early closing (the electromagnetic valve turns on after an initial part of the downward motion of the oil piston, the electromagnetic valve turns off before the valve lift is maximized);

full valve lift (the electromagnetic valve stays on from the beginning of the downward motion of the oil piston until the moment the valve starts closing);

valve deactivation (the electromagnetic valve is off for the entire cycle).

The MultiAir operates according the "Ingoing Air Control", as explained in the US2011/214632 patent application publication that also discloses the necessary modifications to enable the MultiAir to operate either according the "Ingoing Air Control" of Fiat or according the "Outgoing Air Control". In a similar way, a cam of adequately long duration (for instance 400 crankshaft degrees) enables the HyDesmo to operate according all the strategies of the MultiAir and according the "Outgoing Air Control" strategy; for 400 crankshaft degrees valve duration, the duration of the opening ramp of the cam needs to be 200 cam degrees, leaving another 160 cam degrees for the "oil chamber refill" section and for the "base circle" section.

In comparison to the MultiAir system, in this embodiment the restoring motion of the valve is independent on the restoring force of a restoring valve spring and on the characteristics (viscosity etc) of the hydraulic liquid (oil); in the HyDesmo the cam defines the valve motion during the valve opening and during the valve closing.

Without restoring valve springs to compress and to accelerate, the hydraulic circuit pressure (and energy consumption) of the HyDesmo is less, in comparison to MultiAir; the reduced mass of the valve assembly enables higher rev limit. The shorter valves and the absence of valve springs enable a lighter, cheaper and shorter engine.

The HyDesmo is applicable to all poppet valve reciprocating piston engines and pumps.

In the embodiment of FIG. 20, a side-cam pushrod engine, like the big displacement V-8, is modified to HyDesmo; the reprofiled cam (the duration of the opening ramp doubles) displaces directly the oil piston; the oil displaced by the oil piston out from the oil chamber goes, through proper channels, to the valves wherein the opening oil chamber and the closing oil chamber reside, and controls positively both, the valve opening and the valve closing, eliminating the long pushrods, the rocker arms, the pivot shafts, the valve restoring springs and the throttle valve, making the engine cheaper, shorter and simpler; besides, with the infinite valve lift profiles of the HyDesmo, the engine becomes greener and more fuel efficient.

Although the invention has been described and illustrated in detail, the spirit and scope of the present invention are to be limited only by the terms of the appended claims.

The invention claimed is:

1. A desmodromic hydraulic valve train for reciprocating piston engines and pumps comprising at least:

a valve (1) comprising a valve piston (2) and a valve stem (3), the valve piston (2) is secured to the valve stem (3);

an opening oil chamber (4), one end of the valve piston (2) is slidably fitted and seals one side of the opening oil chamber (4);

a closing oil chamber (5), another end of the valve piston (2) is slidably fitted and seals one side of the closing oil chamber (5);

a cam (6);

an oil piston (7);

an oil chamber (8), the oil piston (7) is slidably fitted and seals one side of the oil chamber (8), the cam (6) moves in synchronization to the engine or pump and forces the oil piston (7) to perform an actuating motion wherein the oil piston displaces oil out of the oil chamber (8);

an oil reservoir (11), the cam (6) controls an oil piston (7) restoring motion wherein oil from the oil reservoir (11) enters into the oil chamber (8);

control means (71), (10), and channels (9) connecting controllably the opening oil chamber (4) and the closing oil chamber (5) with the oil chamber (8) and the oil reservoir (11), the actuating motion of the oil piston comprises an initial part wherein the oil from the oil chamber is directed, according to a state of the control means, either to the opening oil chamber and displaces the valve to open positively, or to the closing oil chamber and displaces the valve to close positively, the actuating motion of the oil piston comprises a final part wherein the oil from the oil chamber is directed to the closing oil chamber and displaces the valve to close positively, the final part of the actuating motion is adequately long to guarantee that at the end of the actuating motion of the oil piston the valve will be closed.

2. A desmodromic hydraulic valve train for reciprocating piston engines and pumps, according claim 1, wherein:

the control comprises a control valve (10) having an activation state and a deactivation state, during the initial part of the actuating motion of the oil piston (7), for as long as the control valve (10) is at the activation state, the oil from the oil chamber (8) is directed to the opening oil chamber (4) and opens positively the valve (1), for as long as the control valve (10) is at the deactivation state, the oil from the oil chamber (8) is directed to the closing oil chamber (5) to close positively the valve (1).

3. A desmodromic hydraulic valve train for reciprocating piston engines and pumps, according claim 1, wherein:

an angular displacement of the oil piston (7) relative to the oil chamber (8) controls a valve lift and a valve duration of the valve (1).

4. A desmodromic hydraulic valve train for reciprocating piston engines and pumps, according claim 1, wherein:

an angular displacement of the oil piston relative to the oil chamber controls a valve lift and a valve duration, servomotors and feedback control align the angular displacement of the oil pistons of different oil chambers in order to balance a load of different cylinders.

5. A desmodromic hydraulic valve train for reciprocating piston engines and pumps, according claim 1, wherein:

an angular displacement of the oil piston relative to the oil chamber controls a valve lift and a valve duration, a servomotor controlled by an electronic control unit displaces angularly the oil piston.

6. A desmodromic hydraulic valve train for reciprocating piston engines and pumps, according claim 1, wherein:

the oil piston comprises niches and galleries, the oil chamber comprises ports, an angular displacement of the oil piston relative to the oil chamber controls a valve lift and a valve duration, the oil piston niches and galleries, the oil chamber ports and the channels (9) are such that, during the actuating motion of the oil piston, when the oil chamber directs the oil to the opening oil chamber, the closing oil chamber communicates with the oil reservoir, when the oil chamber directs the oil to the closing oil chamber, the opening oil chamber communicates with the oil reservoir, and after the valve closing the oil chamber (8) directs the oil to the oil reservoir (11).

7. A desmodromic hydraulic valve train for reciprocating piston engines and pumps, according claim 1, wherein:

the cam rotates in synchronization to the engine or pump, the cam comprises a closing ramp controlling the restoring motion of the oil piston, the cam comprises an opening ramp that causes both, the positive valve opening and the positive valve closing, the oil piston is the control means providing controllable communication between the oil chamber, the opening oil chamber, the closing oil chamber and the oil reservoir.

8. A desmodromic hydraulic valve train for reciprocating piston engines and pumps, according claim 1, wherein:

the opening oil chamber comprises hydraulic braking means that decelerate the valve before the valve closes, the closing oil chamber comprises pressure control means (21), (22) that compensate for oil pressure surges and drops.

9. A desmodromic hydraulic valve train for reciprocating piston engines and pumps, according claim 1, wherein:

a single opening ramp of a cam moves in synchronization to the engine or pump and actuates a single oil piston that displaces oil out from an oil chamber, the oil displaced by the oil piston goes to additional oil chambers to open positively and close positively a valve.

* * * * *